US011148694B2

(12) United States Patent
Nian et al.

(10) Patent No.: US 11,148,694 B2
(45) Date of Patent: Oct. 19, 2021

(54) TRAIN TURN-BACK CONTROL METHOD, DEVICE AND SYSTEM

(71) Applicant: BYD COMPANY LIMITED, Shenzhen (CN)

(72) Inventors: Tingyu Nian, Shenzhen (CN); Qiongfang Wang, Shenzhen (CN); Bo Su, Shenzhen (CN); Kaikuo Zhuo, Shenzhen (CN); Faping Wang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 0 days.

(21) Appl. No.: 16/631,050

(22) PCT Filed: May 31, 2018

(86) PCT No.: PCT/CN2018/089329
§ 371 (c)(1),
(2) Date: Jan. 14, 2020

(87) PCT Pub. No.: WO2019/019802
PCT Pub. Date: Jan. 31, 2019

(65) Prior Publication Data

US 2020/0148241 A1 May 14, 2020

(30) Foreign Application Priority Data

Jul. 28, 2017 (CN) ..... 201710631977.7

(51) Int. Cl.
*G05D 1/00* (2006.01)
*G05D 3/00* (2006.01)
(Continued)

(52) U.S. Cl.
CPC ..... *B61L 27/0038* (2013.01)

(58) Field of Classification Search
CPC ..... B61L 27/0038
(Continued)

(56) References Cited

U.S. PATENT DOCUMENTS

2018/0370551 A1* 12/2018 Hou ..... B61L 19/06

FOREIGN PATENT DOCUMENTS

CN 102837713 A 12/2012
CN 103010271 A 4/2013
(Continued)

OTHER PUBLICATIONS

English Translation for CN104742943A.*
(Continued)

*Primary Examiner* — Mahmoud S Ismail
(74) *Attorney, Agent, or Firm* — Anova Law Group, PLLC

(57) ABSTRACT

The present disclosure provides a train turn-back control method, device and system. The method includes: determining first state information of a train when confirming that a turn-back instruction is received; directly resetting the first state information to obtain second state information; and performing turn-back control on the train according to the second state information. The present disclosure can realize turn-back control on the train based on a single set of vehicle on-board-device, thereby improving the turn-back success rate and turn-back efficiency of the train, and reducing the hardware consumption.

13 Claims, 2 Drawing Sheets

(51) Int. Cl.
*G06F 7/00* (2006.01)
*G06F 17/00* (2019.01)
*B61L 27/00* (2006.01)

(58) Field of Classification Search
USPC ..... 701/19
See application file for complete search history.

(56) References Cited

FOREIGN PATENT DOCUMENTS

| | | | | |
|---|---|---|---|---|
| CN | 104203715 | A | | 12/2014 |
| CN | 104742943 | A | * | 7/2015 |
| CN | 104742943 | A | | 7/2015 |
| CN | 104859685 | A | | 8/2015 |
| CN | 105083339 | A | | 11/2015 |
| JP | 2003341518 | A | | 12/2003 |

OTHER PUBLICATIONS

The World Intellectual Property Organization (WIPO) International Search Report for PCT/CN2018/089329 dated Aug. 24, 2018 8 Pages.

* cited by examiner

TRAIN TURN-BACK CONTROL METHOD, DEVICE AND SYSTEM

CROSS-REFERENCE TO RELATED APPLICATIONS

This application a national phase entry under 35 U.S.C. § 371 of International Application No. PCT/CN2018/089329, filed on May 31, 2018, which claims the priority of Chinese Patent Application No. 201710631977.7, entitled "train turn-back control method, device and system", filed on Jul. 28, 2017 by the BYD Co., Ltd., content of all of which is incorporated herein by reference in it entirety.

FIELD

The present invention relates to the technical field of trains and, more particularly, relates to a train turn-back control method, device and system.

BACKGROUND

In related technologies, the control on train turn-back is realized by a zone controller as a third party based on two sets of vehicle on-board-devices on a train. Under the condition that one set of vehicle on-board-devices at a vehicle on-board leading side is in communication link with the zone controller, the other set of vehicle on-board-device at a non-leading side establishes a communication link with the zone controller in advance, so as to initiate registration to the zone controller, and after the registration is successful, the on board device and the on board device are interchanged to control the turn-back of the train.

In such mode, the non-leading side needs to establish the communication link with the zone controller, and the non-leading side needs to make a request for registration to the zone controller after establishing the communication link with the zone controller, which affects the turn-back success rate and the turn-back efficiency.

SUMMARY

The present disclosure aims to solve one of the technical problems in the related art at least to a certain extent.

Therefore, one objective of the present disclosure is to provide a train turn-back control method which can realize turn-back control on a train based on a single set of vehicle on-board-device, thereby improving the turn-back success rate and turn-back efficiency of the train, and reducing the hardware consumption.

Another objective of the present disclosure is to provide a train turn-back control device.

Another objective of the present disclosure is to provide a train turn-back control system.

In order to achieve the above objective, a first embodiment of the present disclosure provides a train turn-back control method, including: determining current first state information of a train when confirming that a turn-back instruction is received; resetting the first state information to obtain second state information; and performing turn-back control on the train according to the second state information.

According to the train turn-back control method provided by the first embodiment of the present disclosure, the current first state information of the train is determined when confirming that the turn-back instruction is received, the current first state information of the train is reset to obtain the second state information, and turn-back control on the train is performed according to the second state information, so as to realize turn-back control on the train based on a single set of vehicle on-board-device, thereby improving the turn-back success rate and turn-back efficiency of the train, and reducing the hardware consumption.

In order to achieve the above objective, a second embodiment of the present disclosure provides a train turn-back control device, including: a determining module, configured to determine the current first state information of a train when confirming that a turn-back instruction is received; a resetting module, configured to directly reset the current first state information of the train to obtain second state information; and a turn-back control module, configured to perform turn-back control on the train according to the second state information.

According to the train turn-back control device provided by the second embodiment of the present disclosure, the current first state information of the train is determined when confirming that the turn-back instruction is received, the current first state information of the train is reset to obtain the second state information, and turn-back control on the train is performed according to the second state information, so as to realize turn-back control on the train based on a single set of vehicle on-board-device, thereby improving the turn-back success rate and turn-back efficiency of the train, and reducing the hardware consumption.

In order to achieve the above objective, a third embodiment of the present disclosure provides a train turn-back control system, including: the train turn-back control device provided by the second embodiment of the present disclosure.

According to the train turn-back control system provided by the third embodiment of the present disclosure, the current first state information of a train is when confirming that a turn-back instruction is received, the current first state information of the train is reset to obtain second state information, and turn-back control on the train is performed according to the second state information, so as to realize turn-back control on the train based on a single set of vehicle on-board-device, thereby improving the turn-back success rate and turn-back efficiency of the train, and reducing the hardware consumption.

Other aspects and advantages of the present disclosure will be given in the following description, some of which will become apparent from the following description or may be learned from practices of the present disclosure.

BRIEF DESCRIPTION OF THE DRAWINGS

The foregoing and/or additional aspects and advantages of the present disclosure will become apparent and comprehensible in the description made with reference to the following accompanying drawings, where.

DETAILED DESCRIPTION

The following describes embodiments of the present disclosure in detail. Examples of the embodiments are shown in the accompanying drawings, and same or similar reference signs in all the accompanying drawings indicate same or similar components or components having same or similar functions. The embodiments that are described with reference to the accompany drawings are exemplary, and are only used to interpret the present disclosure, instead limiting the present disclosure. On the contrary, the embodiments of the present disclosure include all changes, modifications, and equivalents falling within the spirit and scope of the appended claims.

Figure 1:
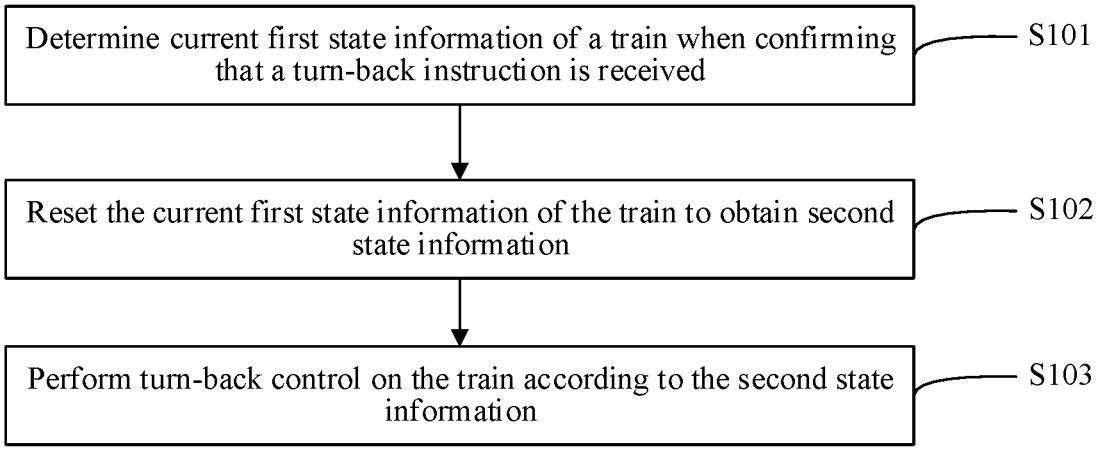
FIG. 1 is a flow diagram of a train turn-back control method provided by an embodiment of the present disclosure.

FIG. 1 is a flow diagram of a train turn-back control method provided by an embodiment of the present disclosure.

The present embodiment is exemplified by configuring the train turn-back control method in a train turn-back control device.

The train turn-back control method is configured to perform turn-back control on a train.

In general, the control on train turn-back is realized by a zone controller as a third party based on two sets of vehicle on-board-devices on a train. Specifically, the control on train turn-back is realized based on one set of vehicle on-board-device at a vehicle on board n leading side and another set of vehicle on-board-device at a non-leading side. Under the condition that the set of vehicle on-board-device at the vehicle on board leading side is in communication link with the zone controller, the set of vehicle on-board-device at the non-leading side establishes a communication link with the zone controller in advance, so as to initiate registration to the zone controller, and after the registration is successful, the head (leading side) and the tail (non-leading side) are interchanged to control the turn-back of the train.

In such mode, the non-leading side needs to establish the communication link with the zone controller, and the non-leading side needs to make request for registration to the zone controller after establishing the communication link with the zone controller, which affects the turn-back success rate and the turn-back efficiency.

According to the embodiments of the present disclosure, in the process of controlling the turn-back of the train, the single set of vehicle on-board-device on the train directly resets the current state information of the train, and then, the single set of vehicle on-board-device controls the train to run out of a turn-back rail and run to a station parking spot after the resetting is completed.

Referring to FIG. 1, the method includes:

S101: determining current first state information of a train when confirming that a turn-back instruction is received.

Optionally, the current first state information of the train includes at least one of a first train head position, a first train tail position and a first running direction of the train at present.

Further, the current first state information of the train may also includes a driving mode, a train door state, a registration state at a zone controller side and the like, and it is not limited thereto.

Further, the current first state information of the train can be obtained by a single set of vehicle on-board-device on the train when confirming that the turn-back instruction is received. For example, the current first state information of the train can be obtained from a vehicle data recorder of the train.

Figure 2:
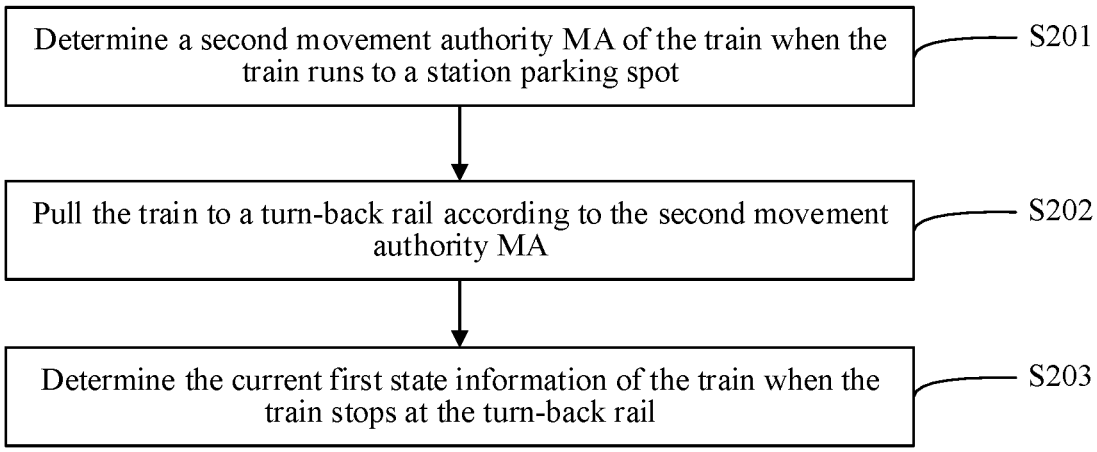
FIG. 2 is a flow diagram of a train turn-back control method provided by another embodiment of the present disclosure.

Optionally, in some embodiments, referring to FIG. 2, determining the current first state information of the train includes:

S201: when the train runs to a station parking spot, determining a second Movement Authority (MA) of the train;

S202: pulling the train to a turn-back rail according to the second movement authority MA; and

S203: when the train stops at the turn-back rail, determining the current first state information of the train.

The movement authority MA refers to a line from the tail of the train to an obstacle at a destination ahead. The obstacle includes a route destination, a turnout, a train ahead, or the like. When the train runs in a controlled line zone according to a normal schedule, a Vehicle On Board Controller (VOBC) sends a position and a running direction of the train to a Zone Controller (ZC), and determines whether to apply for the extension of the MA to the ZC according to its own braking curve, the ZC determines the MA of each train according to the current position of the train, a driving direction, a route and current states of the surrounding lines, and then, a Database Communication System (DCS) sends the movement authority MA of the train to the VOBC.

According to the working principle of the turn-back of the train, after running to the station parking spot, the train needs to further run to the turn-back rail, and the turn-back control on the train is completed in the turn-back rail.

Therefore, in the embodiments of the present disclosure, when the train runs to the station parking spot, the current MA of the train can be determined as the second movement authority MA, and the second movement authority MA refers to a line from the tail of the train to the destination of the turn-back rail.

After the current second movement authority MA of the train is determined, the train can be pulled to the turn-back rail by the VOBC according to the second movement authority MA, and when the train stops at the turn-back rail, the current first state information of the train can be determined. For example, when the train is pulled to the turn-back rail by the VOBC, whether the current position is the turn-back rail can be detected in real time, and whether the train stops steadily can be monitored. If the current position is the turn-back rail and the train stops steadily, determining the current first state information of the train can be triggered.

Or, after the conditions of turn-back control on the train are met, determining the current first state information of the train can be triggered by a user and it is not limited thereto.

When the train runs to the station parking spot, the current second movement authority MA of the train is determined and the train is pulled to the turn-back rail according to the second movement authority MA, and when the train stops at the turn-back rail, the current first state information of the train is determined to perform turn-back control on the train, so that the automation of the turn-back control on the train can be realized, the turn-back effect is guaranteed, and the consumption of human resources is saved.

S102: Resetting the current first state information of the train to obtain second state information.

S103: Performing turn-back control on the train according to the second state information.

Optionally, directly resetting the current first state information of the train includes: interchanging the first train head position with the first train tail position and performing a reverse operation on the first running direction to obtain a second train head position, a second train tail position and a second running direction. The second running direction is opposite to the first running direction.

Performing turn-back control on the train according to the reset second state information includes: performing turn-back control on the train according to the second train head position, the second train tail position and the second running direction.

The current first state information of the train is reset, that is, the corresponding data of the first train head position and the first train tail position in the current first state information of the train is reset, that is, the first train head position and the first train tail position are interchanged, and the corresponding data of the first running direction in the current first state information of the train is reset, that is, the reverse operation is performed on the first running direction to obtain the second train head position, the second train tail position and the second running direction.

In the present embodiment, the current first state information of the train is determined when confirming that the turn-back instruction is received, the current first state information of the train is reset to obtain the second state information, and the turn-back control is performed on the train according to the second state information, so as to realize turn-back control on the train based on a single set of vehicle on-board-device, thereby improving the turn-back success rate and turn-back efficiency of the train, and reducing the hardware consumption.

Figure 3:
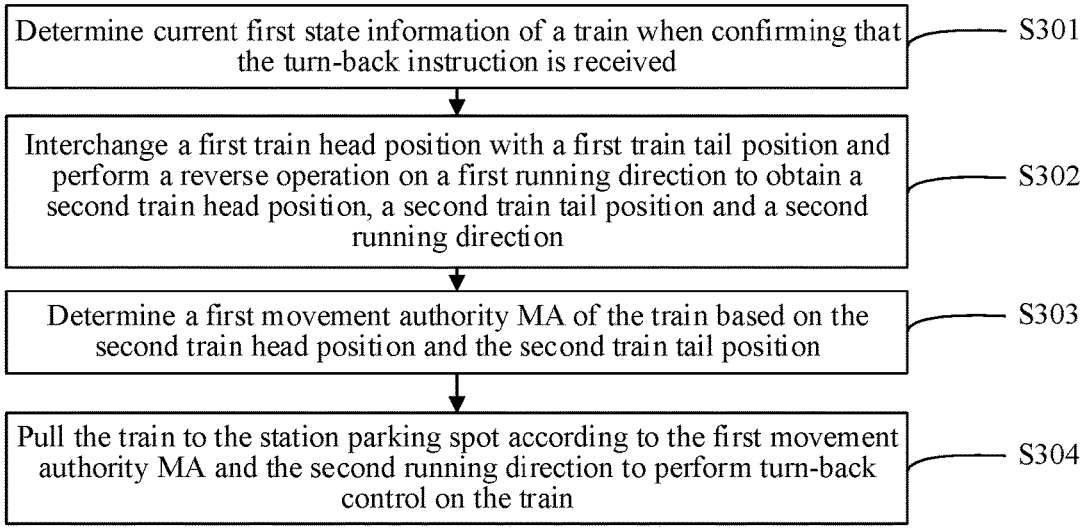
FIG. 3 is a flow diagram of a train turn-back control method provided by another embodiment of the present disclosure.

FIG. 3 is a flow diagram of a train turn-back control method provided by another embodiment of the present disclosure.

Referring to FIG. 3, the method includes:

S301: determining current first state information of a train when confirming that a turn-back instruction is received.

Optionally, the current first state information of the train includes at least one of a first train head position, a first train tail position and a first running direction of the train at present.

S302: Interchanging the first train head position with the first train tail position and performing a reverse operation on the first running direction to obtain a second train head position, a second train tail position and a second running direction.

S301 and S302 refer to the above embodiments.

S303: Determining the first movement authority MA of the train based on the second train head position and the second train tail position.

The first movement authority MA refers to a line from the second train tail position to a station parking spot.

Optionally, when the train is positioned in a control zone of a zone controller, the second train head position and the second train tail position are sent to the zone controller, and the zone controller determines the first movement authority MA of the train based on the second train head position and the second train tail position. In this case, a single set of vehicle on-board-device can read the first movement authority MA directly from the zone controller.

Or, the first movement authority MA of the train can be determined directly by the VOBC based on the second train head position and the second train tail position and it is not limited thereto.

S304: Pulling the train to the station parking spot according to the first movement authority MA and the second running direction to perform turn-back control on the train.

For example, the steps are as follows:

S1, a VOBC is in a communication-based automatic train control mode, enables a train to run to a station parking spot in front of a turn-back rail, and completes boarding and landing operations;

S2, the VOBC receives a turn-back instruction, where the turn-back instruction is the destination of the movement authority MA being a turn-back rail that is transmitted by a ZC or calculated by a single set of vehicle on-board-device, and outputs turn-back indicator lamp flashing;

S3, after a driver presses a turn-back button and the VOBC receives the information that the turn-back button is pressed (by the driver), an equivalent key signal and an indicator lamp keeping on instruction are output, and a console indicator lamp keeps on;

S4, the VOBC dispatches the train, and controls the train to run to the turn-back rail and stop steadily according to a second movement authority MA calculation curve;

S5, after detecting that the train stops steadily at a turn-back parking spot and detecting that the train stops steadily at the parking spot of the turn-back rail, the VOBC judges that the train completely enters the turn-back rail, and directly resets the current state information of the train;

S6, if there is a ZC, a single set of vehicle on-board-device reports the position to the ZC, the ZC calculates the first movement authority MA, otherwise, the VOBC calculates the first movement authority MA by itself according to basic information of a ground central device;

S7, the VOBC updates a target point to the station parking spot, and under the protection of the first movement authority MA, the train is pulled back to stop at the station parking spot; and S8, the driver gets on the train, and inserts a key, the turn-back indicator lamp is turned off, the train operates on a main line, and the automatic turn-back is finished.

In one embodiment, the current first state information of the train is determined when confirming that the turn-back instruction is received, the current first state information of the train is reset to obtain second state information, and turn-back control is performed on the train according to the second state information, so as to realize turn-back control on the train based on a single set of vehicle on-board-device, thereby improving the turn-back success rate and turn-back efficiency of the train, and reducing the hardware consumption. The current first movement authority MA of the train is determined by the single set of vehicle on-board-device based on the second train head position and the second train tail position which are obtained by interchanging, and the movement authority MA can be calculated according to a ground device without relying on the zone controller, thereby further reducing the hardware consumption.

Figure 4:
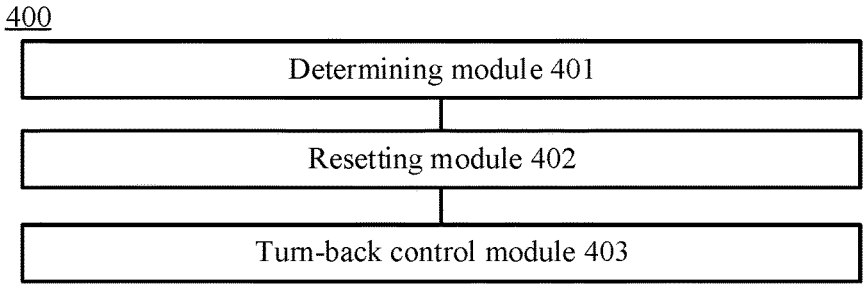
FIG. 4 is a structural schematic diagram of a train turn-back control device provided by an embodiment of the present disclosure.

FIG. 4 is a structural schematic diagram of a train turn-back control device provided by an embodiment of the present disclosure.

Referring to FIG. 4, a train turn-back control device 400 is provided by the present disclosure. In some embodiments, the device 400 includes one or more processors and one or more memories for storing instructions. When the stored instructions are executed, the processor can perform the train turn-back control functions. The processor includes a determining module 401, a resetting module 402 and a turn-back control module 403.

The determining module 401 is configured to determine current first state information of a train when confirming that a turn-back instruction is received.

Optionally, in some embodiments, the determining module 401 is specifically configured to:

determine the second movement authority MA of the train when the train runs to a station parking spot;

pull the train to a turn-back rail according to the second movement authority MA; and determine the first state information of the train when the train stops at the turn-back rail.

The resetting module 402 is configured to reset the current first state information of the train to obtain second state information.

Optionally, in some embodiments, the current first state information of the train includes at least one of a first train head position, a first train tail position and a first running direction of the train at present. The resetting module 402 is specifically configured to:

interchange the first train head position with the first train tail position and perform a reverse operation on the first running direction to obtain a second train head position, a second train tail position and a second running direction. The second running direction is opposite to the first running direction.

The turn-back control module 403 is configured to perform turn-back control on the train according to the second state information.

Optionally, in some embodiments, the turn-back control module 403 is specifically configured to:

perform turn-back control on the train according to the second train head position, the second train tail position and the second running direction.

Figure 5:
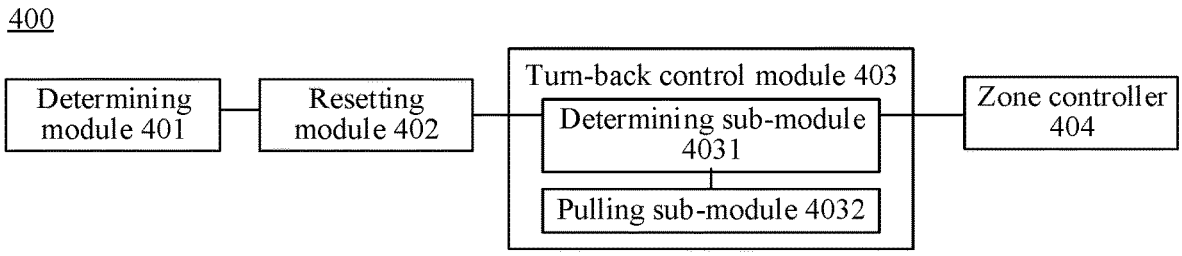
FIG. 5 is a structural schematic diagram of a train turn-back control device provided by another embodiment of the present disclosure.

Optionally, in some embodiments, referring to FIG. 5, the turn-back control module 403 includes:

a determining sub-module 4031, configured to determine the first movement authority MA of the train based on the second train head position and the second train tail position; and a pulling sub-module 4032, configured to pull the train to the station parking spot according to the first movement authority MA and the second running direction to perform turn-back control on the train.

The device 400 also includes a zone controller 404. When the train is positioned in a control zone of the zone controller, the determining sub-module 4031 is specifically configured to:

send the second train head position and the second train tail position to the zone controller 404.

The zone controller 404 is configured to determine the first movement authority MA of the train based on the second train head position and the second train tail position.

The determining sub-module 4031 is also specifically configured to:

determine the first movement authority MA of the train based on the second train head position and the second train tail position.

It should be noted that the explanation of the embodiment of the train turn-back control method in the above embodiments of FIG. 1 to FIG. 3 is also applicable to the train turn-back control device 400 of the present embodiment, and the implementation principle thereof is similar, so that details are omitted herein.

In the present embodiment, the current first state information of the train is determined when confirming that the turn-back instruction is received, the current state information of the train is reset to obtain second state information, and turn-back control is performed on the train according to the second state information, so as to realize turn-back control on the train based on a single set of vehicle on-board-device, thereby improving the turn-back success rate and turn-back efficiency of the train, and reducing the hardware consumption.

It should be noted that in the description of the present disclosure, the terms "first", "second", and the like are merely used for description, and shall not be understood as an indication or implication of relative importance. In addition, in the description of the present disclosure, unless otherwise stated, "a plurality of" means two or more than two.

Description of any process or method that is described in a flowchart or in other manners herein may be understood as including one or more modules, segments, or parts including code of executable instructions for performing steps for implementing specific logical functions or processes, and the scope of preferred implementations of the present disclosure includes other implementations in which functions may be performed in another order including in a substantially simultaneous manner according to related functions or an order reverse to the shown or discussed order, instead of the shown or discussed order. This should be understood by a person skilled in the art to which the embodiments of the present disclosure relate.

It should be understood that, parts of the present disclosure can be implemented by using hardware, software, firmware, or a combination thereof. In the foregoing implementations, a plurality of steps or methods may be implemented by using software or firmware that are stored in a memory and are executed by a proper instruction execution system. For example, if being implemented by hardware, like another implementation, the plurality of steps or methods may be implemented by any one of following common technologies in the art or a combination thereof: a discrete logic circuit of a logic gate circuit for realizing a logic function for a data signal, an application-specific integrated circuit having a suitable combined logic gate circuit, a programmable gate array (PGA), and a field programmable gate array (FPGA).

A person of ordinary skill in the art may understand that all or some of the steps of the method embodiments may be implemented by a program instructing relevant hardware. The program may be stored in a computer-readable storage medium. When the program is run, one or a combination of the steps of the method embodiments are performed.

In addition, the functional modules in the embodiments of the present disclosure may be integrated into one processing module, or each of the units may exist alone physically, or two or more units may be integrated into one module. The integrated module may be implemented in a hardware form, or may be implemented in a form of a software functional module. If implemented in the form of software functional modules and sold or used as an independent product, the integrated module may also be stored in a computer-readable storage medium.

The aforementioned storage medium may be a read-only memory, a magnetic disk, or an optical disc.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of the present disclosure. In this specification, schematic descriptions of the foregoing terms do not necessarily directed at a same embodiment or example. Moreover, the specific features, structures, materials, or characteristics described may be combined in any one or more embodiments or examples in an appropriate manner.

Although the embodiments of the present disclosure have been shown and described above, it can be understood that, the foregoing embodiments are exemplary and should not be understood as limitation to the present disclosure. A person of ordinary skill in the art can make changes, modifications, replacements, or variations to the foregoing embodiments within the scope of the present disclosure.

What is claimed is:

1. A train turn-back control method based on a single set of vehicle on-board-device, comprising:

determining a pre-turn-back movement authority (MA) when a train runs to a first station parking spot, wherein the pre-turn-back MA is a line from an initial tail position of the train to a destination of a turn-back rail;

pulling a train to the turn-back rail according to the pre-turn-back MA;

when the train stops at the turn-back rail, in response to confirming that a turn-back instruction being received, determining current first state information of the train, wherein the current first state information includes at least one of a first train head position, a first train tail position, and a first train running direction;

resetting the first state information to obtain second state information, wherein the second state information includes a second train head position, a second train tail position, and a second train running direction;

determining a turn-back MA of the train based on the second train head position and the second train tail position, wherein the turn-back MA is a line from the second tail position to a second station parking spot; and pulling the train to the second station parking spot according to the turn-back MA and the second train running direction to complete turn-back control on the train.

2. The train turn-back control method according to claim 1, wherein:

resetting the first state information to obtain the second state information comprises:

interchanging the first train head position with the first train tail position, and performing a reverse operation on the running direction to obtain the second train head position, the second train tail position and the second running direction.

3. The train turn-back control method according to claim 2, wherein determining the turn-back MA of the train based on the second train head position and the second train tail position comprises:

sending, when the train is positioned in a control zone of a zone controller, the second train head position and the second train tail position to the zone controller; wherein the zone controller is configured to determine the turn-back MA of the train based on the second train head position and the second train tail position.

4. The train turn-back control method according to claim 2, wherein determining the turn-back MA of the train based on the second train head position and the second train tail position comprises:

determining the turn-back MA of the train based on the second train head position and the second train tail position by a vehicle on board controller.

5. A train turn-back control device based on a single set of vehicle on-board-device, comprising:

a processor; and a memory for storing instructions, when executed, causing the processor to control a train to turn back, wherein:

the processor comprises:

a determining module configured to:

determine a pre-turn-back movement authority (MA) when the train runs to a first station parking spot, wherein the pre-turn-back MA is a line from an initial tail position of the train to a destination of a turn-back rail;

control pulling the train to the turn-back rail according to the pre-turn-back MA;

when the train stops at the turn-back rail, in response to confirming that a turn-back instruction being received, determine current first state information of the train, wherein the current first state information includes at least one of a first train head position, a first train tail position, and a first train running direction; and determine a turn-back MA of the train based on a second train head position and a second train position, wherein the turn-back MA is a line from the second tail position to a second station parking spot;

a resetting module configured to reset the first state information to obtain second state information, wherein the second state information includes the second train head position, the second train tail position, and a second train running direction; and a turn-back control module configured to pull the train to the second station parking spot according to the turn-back MA and the second train running direction.

6. The train turn-back control device according to claim 5, wherein:

the resetting module is specifically configured to:

interchange the first train head position with the first train tail position, and perform a reverse operation on the running direction to obtain the second train head position, the second train tail position and the second running direction; and the turn-back control module is specifically configured to:

pull the train to the second station parking spot according to the turn-back MA and the second train running direction.

7. The train turn-back control device according to claim 6, wherein the turn-back control module comprises:

a determining sub-module configured to determine the turn-back MA of the train based on the second train head position and the second train tail position; and a pulling sub-module configured to pull the train to the second station parking spot according to the turn-back MA and the second running direction to complete turn-back control on the train.

8. The train turn-back control device according to claim 7, wherein the device also comprises a zone controller; when the train is positioned in a control zone of the zone controller, the determining sub-module is specifically configured to:

send the second train head position and the second train tail position to the zone controller when the train is positioned in a control zone of the zone controller; and the zone controller is configured to determine the turn-back MA of the train based on the second train head position and the second train tail position.

9. The train turn-back control device according to claim 7, wherein the determining sub-module is also specifically configured to:

determine the turn-back MA of the train by a vehicle on board controller based on the second train head position and the second train tail position.

10. A train turn-back control system based on a single set of vehicle on-board-device, comprising:

a zone controller; and a train turn-back control device, including:

a processor; and a memory for storing instructions, when executed, causing the processor to control a train to turn back, wherein:

the processor includes:

a determining module configured to:

determine a pre-turn-back movement authority (MA) when the train runs to a first station parking spot, wherein the pre-turn-back MA is a line from an initial tail position of the train to a destination of a turn-back rail;

control the pulling train to the turn-back rail according to the pre-turn-back MA;

when the train stops at the turn-back rail, in response to confirming that a turn-back instruction being received, determine current first state information of the train, wherein the current first state information includes at least one of a first train head position, a first train tail position, and a first train running direction; and determine a turn-back MA of the train based on a second train head position and a second train position, wherein the turn-back MA is a line from the second tail position to a second station parking spot;

a resetting module configured to reset the first state information to obtain second state information, wherein the second state information includes the second train head position, the second train tail position, and a second train running direction; and a turn-back control module configured to pull the train to the second station parking spot according to the turn-back MA and the second train running direction.

11. The train turn-back control system according to claim 10, wherein:

the resetting module is specifically configured to:

interchange the first train head position with the first train tail position, and perform a reverse operation on the running direction to obtain the second train head position, the second train tail position and the second running direction; and the turn-back control module is specifically configured to:

pull the train to the second station parking spot according to the turn-back MA and the second train running direction.

12. The train turn-back control system according to claim 11, wherein the turn-back control module comprises:

a determining sub-module configured to determine the turn-back MA of the train based on the second train head position and the second train tail position; and a pulling sub-module configured to pull the train to the second station parking spot according to turn-back MA and the second running direction to complete turn-back control on the train.

13. The train turn-back control system according to claim 12, wherein, when the train is positioned in a control zone of the zone controller, the determining sub-module is specifically configured to:

send the second train head position and the second train tail position to the zone controller when the train is positioned in a control zone of the zone controller; and the zone controller is configured to determine the turn-back MA of the train based on the second train head position and the second train tail position.

* * * * *